US008328337B2

(12) United States Patent
Kubo

(10) Patent No.: US 8,328,337 B2
(45) Date of Patent: Dec. 11, 2012

(54) LIQUID DROPLET DISCHARGE APPARATUS AND IMAGE RECORDING APPARATUS

(75) Inventor: Tomoyuki Kubo, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 261 days.

(21) Appl. No.: 12/891,627

(22) Filed: Sep. 27, 2010

(65) Prior Publication Data

US 2011/0074886 A1 Mar. 31, 2011

(30) Foreign Application Priority Data

Sep. 30, 2009 (JP) ..... 2009-226291

(51) Int. Cl.
*B41J 2/05* (2006.01)

(52) U.S. Cl. ..... 347/58

(58) Field of Classification Search ..... 347/50, 347/55, 58–59, 68
See application file for complete search history.

(56) References Cited

FOREIGN PATENT DOCUMENTS

JP 2003-053940 A 2/2003
JP 2009-241438 A 10/2009

*Primary Examiner* — Lamson Nguyen
(74) *Attorney, Agent, or Firm* — Baker Botts L.L.P.

(57) ABSTRACT

A liquid droplet discharge apparatus includes a liquid droplet discharge head having a plurality of nozzles which discharge liquid droplets and a pressure applying mechanism which selectively applies a pressure to discharge the liquid droplets from the nozzles; a first wiring board which is flexible and which is connected to the pressure applying mechanism; and a second wiring board which is connected to the first wiring board; and the first wiring board has a pair of extending portions which extend on mutually opposite sides from a connecting portion to be connected to the pressure applying mechanism, the pair of extending portions are bent so that forward end portions thereof face each other, and the second wiring board is connected to the pair of extending portions so that the second wiring board overlaps the mutually facing forward end portions of the pair of extending portions.

12 Claims, 7 Drawing Sheets

LIQUID DROPLET DISCHARGE APPARATUS AND IMAGE RECORDING APPARATUS

CROSS REFERENCE TO RELATED APPLICATION

The present application claims priority from Japanese Patent Application No. 2009-226291 filed on Sep. 30, 2009, the disclosures of which are incorporated herein by reference in their entirety.

BACKGROUND OF THE INVENTION

1. Field of the Invention

The present invention relates to a liquid droplet discharge apparatus for discharging liquid droplets of, for example, an ink and an image recording apparatus which is provided with the liquid droplet discharge apparatus. In particular, the present invention relates to a liquid droplet discharge apparatus including a first wiring board and a second wiring board which are flexible and which are arranged in connection with a pressure applying mechanism for selectively applying the pressure in order to discharge liquid droplets from nozzles.

2. Description of the Related Art

An ink discharge apparatus, which is a representative example of the liquid droplet discharge apparatus, includes a plurality of nozzles which discharge the ink and a pressure applying mechanism which applies the pressure in order to discharge the ink from the nozzles. An ink-jet printer, which carries the ink discharge apparatus, is provided with a control board to control the operation of the pressure applying mechanism. The pressure applying mechanism is mechanically and electrically connected to the control board via a wiring member composed of a plurality of flexible wiring boards which are arranged in connection with each other.

In general, the wiring member of the ink discharge apparatus is composed of a COF board which is connected to the pressure applying mechanism and an FPC board which is connected to the control board. The COF board has a connecting portion which is connected to the pressure applying mechanism and an extending portion which is led out from the connecting portion. A forward end portion of the FPC board is connected to a forward end portion of the extending portion by using, for example, a solder. A signal supply section, which supplies the driving signal to drive the pressure applying mechanism, is mounted on the extending portion of the COF board. Further, wiring lines for supplying the driving signal are formed thereon, which extend from the signal supply section to the connecting portion. The plurality of wiring lines are provided corresponding to the number of nozzles in order that the respective nozzles can discharge the ink independently from each other.

In recent years, it is demanded to increase the number of nozzles in order to improve the printing speed and the resolution. In order to respond to this demand, Japanese Patent Application Laid-open No. 2003-53940 discloses a liquid droplet discharge apparatus in which any COF board is abandoned from the wiring member, a signal supply section is mounted one by one on each of two sheets of FPC boards, and the FPC boards are connected to a pressure applying mechanism respectively. Accordingly, the arrangement space, which is required for wiring lines for supplying the driving signal extending from each of the signal supply section, is distributed to the two FPC boards. Therefore, the degree of freedom of the wiring layout is improved.

However, according to this arrangement, it is necessary to mount two connectors on a control board in order to connect the two FPC wiring boards. This results in the large size of the control board, which takes up the restricted arrangement space in an ink-jet printer.

SUMMARY OF THE INVENTION

In view of the above, an object of the present invention is to suppress the production cost of a liquid droplet discharge apparatus and produce the liquid droplet discharge apparatus easily and stably.

The present invention has been made taking the foregoing circumstances into consideration. According to a first aspect of the present invention, there is provided a liquid droplet discharge apparatus which discharges liquid droplets; including a liquid droplet discharge head having a plurality of nozzles which discharge the liquid droplets and a pressure applying mechanism which selectively applies a pressure to discharge the liquid droplets from the nozzles; a first wiring board which is flexible and which is connected to the pressure applying mechanism; and a second wiring board which is connected to the first wiring board; and the first wiring board has a pair of extending portions which extend on mutually opposite sides from a connecting portion to be connected to the pressure applying mechanism, the pair of extending portions are bent so that forward end portions thereof face each other, and the second wiring board is connected to the pair of extending portions so that the second wiring board overlaps the mutually facing forward end portions of the pair of extending portions.

According to the arrangement as described above, one sheet of the second wiring board is connected to one sheet of the first wiring board. Therefore, it is possible to suppress the production cost and it is possible to simplify the production steps, as compared with a case in which two sheets of second wiring boards are connected to one sheet of first wiring board.

According to the present invention as defined above, it is possible to suppress the production cost of the liquid droplet discharge apparatus, and it is possible to produce the liquid droplet discharge apparatus easily and stably.

BRIEF DESCRIPTION OF THE DRAWINGS

FIG. 3 illustrates the process for producing the ink discharge apparatus shown in FIG. 1, wherein

FIG. 5 illustrates the process for producing the ink discharge apparatus shown in FIG. 1, wherein

DESCRIPTION OF THE PREFERRED EMBODIMENTS

An embodiment of the present invention will be explained below with reference to the drawings. An ink discharge apparatus, which is to be carried on an ink-jet printer, is herein exemplified as the embodiment of the liquid droplet discharge apparatus according to the present invention by way of example. The direction, in which the ink or inks is/are discharged from the ink discharge apparatus, is designated as the downward direction.

Figure 7:
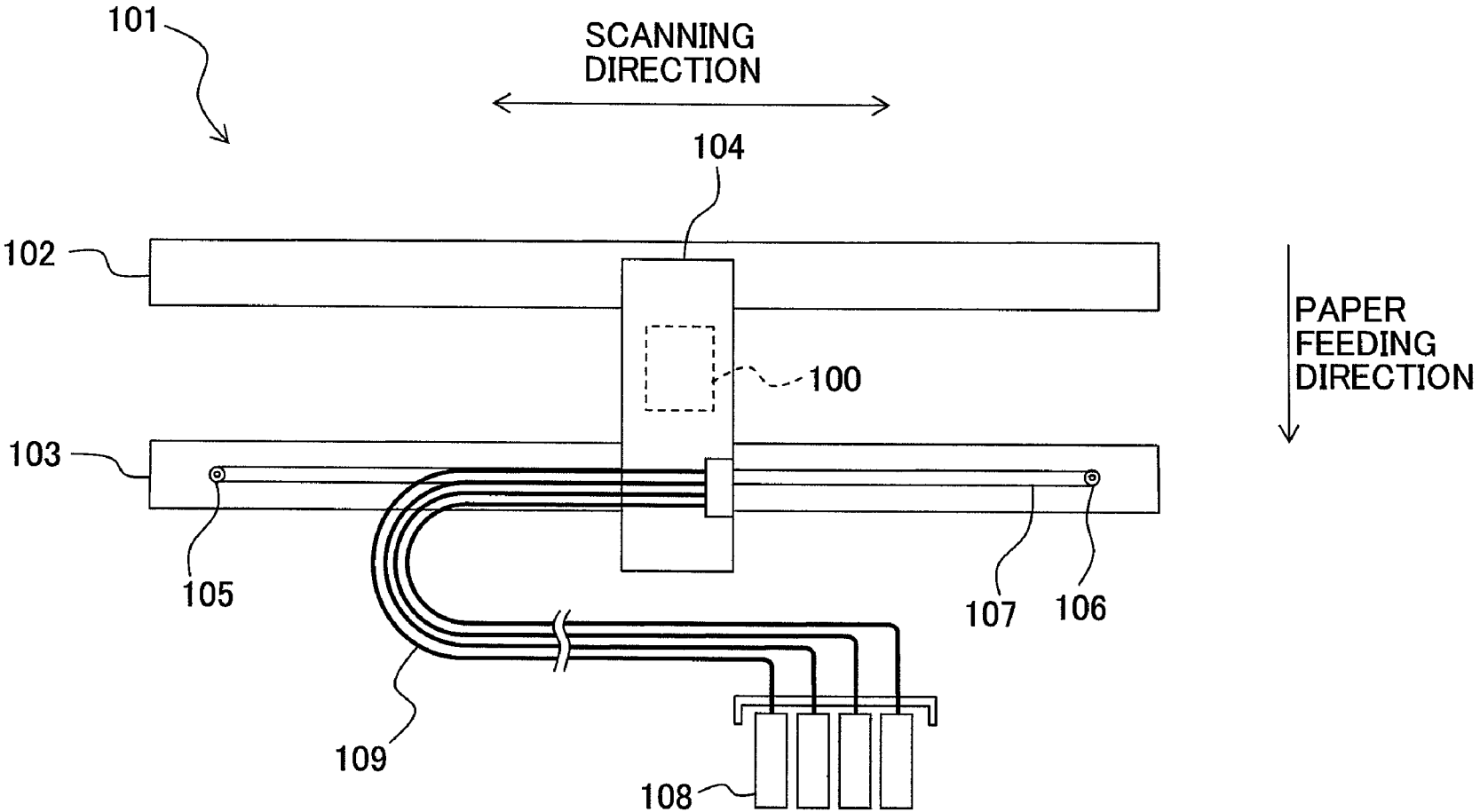
FIG. 7 shows schematic plan view illustrating main components of an image recording apparatus provided with the ink discharge apparatus of the present invention.

At first, an overall arrangement of the ink-jet printer as an image recording apparatus will be explained. As shown in FIG. 7, a pair of guide rails 102, 103, which extend in the left-right direction, are arranged substantially in parallel for the ink-jet printer 101. A liquid supply unit 104 is supported by the guide rails 102, 103 so that the liquid supply unit 104 is slidable in a scanning direction (left-right direction in FIG. 1). A pair of pulleys 105, 106 are provided in the vicinity of left and right end portions of the guide rail 103. The liquid supply unit 104 is joined to a timing belt 107 applied and wound around the pulleys 105, 106. A motor (not shown), which is driven and rotated in the positive or negative (clockwise or counterclockwise) direction, is provided for the one pulley 106. When the pulley 106 is driven and rotated in the positive or negative direction, the timing belt 107 is reciprocatively moved in the leftward direction or the rightward direction. Accordingly, the liquid supply unit 104 is reciprocatively scanned in the left-right direction along with the guide rails 102, 103.

Four ink cartridges 108 are attached to the ink jet printer 101 so that the four ink cartridges 108 are detachable for the exchange. Four flexible ink supply tubes 109 are connected to the liquid supply unit 104 in order to supply four color inks (for example, black, cyan, magenta, and yellow) from the ink cartridges 108 respectively. The liquid supply unit 4 is provided with a carriage 100 which carries the ink discharge apparatus 1. The inks (liquids) are jetted from the ink discharge apparatus 1 toward a recording medium (for example, recording paper) which is transported in the direction (paper feeding direction) perpendicular to the scanning direction thereunder or therebelow. Thus, an image is formed on the recording medium.

Figure 1:
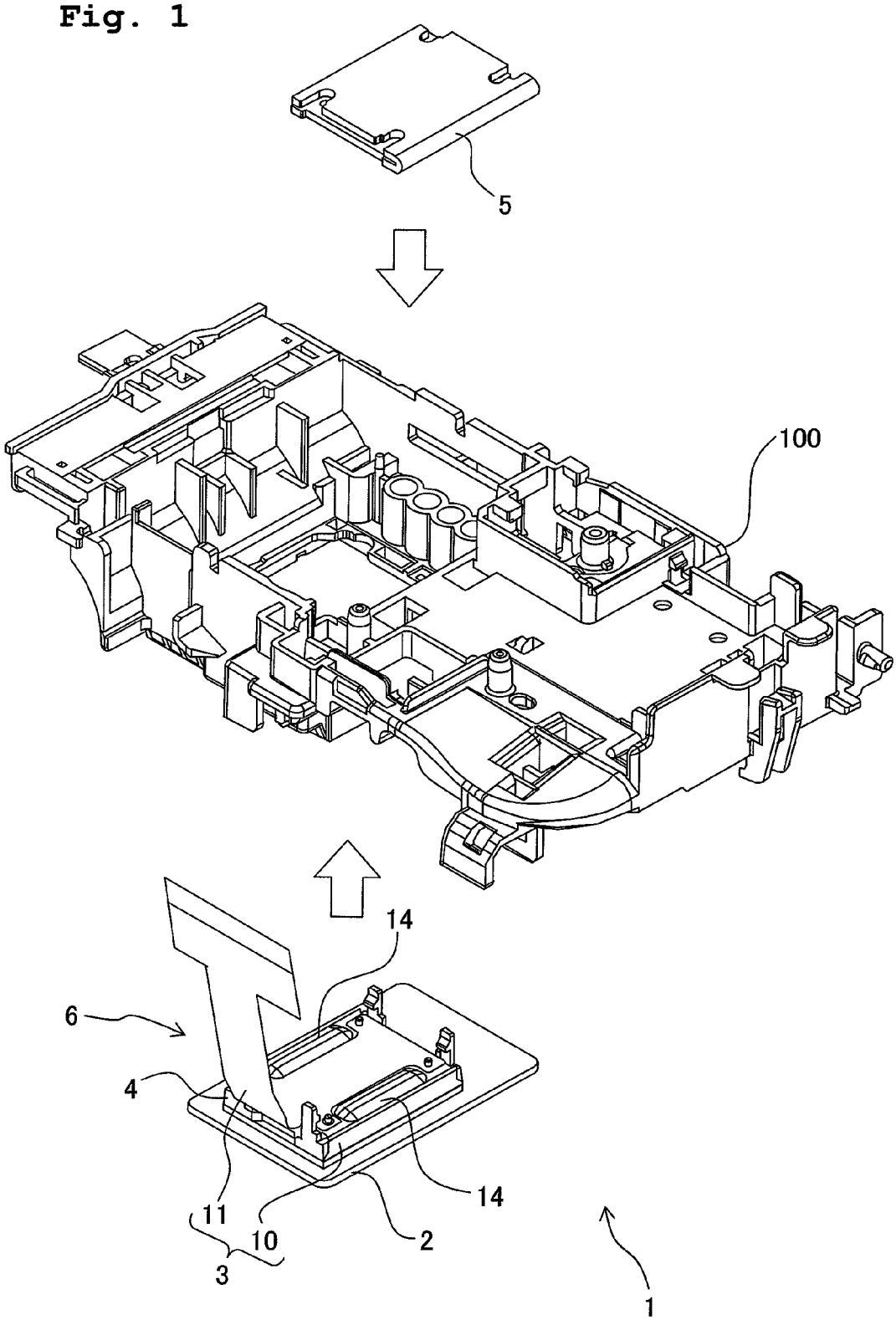
FIG. 1 shows an exploded perspective view illustrating an ink discharge apparatus according to an embodiment of the present invention, which depicts a perspective view of the ink discharge apparatus in a state provided before the ink discharge apparatus is carried on a carriage of an ink jet printer.

As shown in FIG. 1, the ink discharge apparatus 1 is carried on the carriage 100 of the ink-jet printer 101. The ink discharge apparatus 1, which is carried on the carriage 100, is movable over or above the recording surface of the recording medium, and the ink discharge apparatus 1 discharges the ink toward the recording surface. The discharged ink is landed on the recording surface, and thus a required image and/or letters is/are recorded on the recording medium.

The ink discharge apparatus 1 includes an ink-jet head 2 which has a large number of nozzles (not shown) for discharging the ink, a wiring member (wiring assembly) 3 which is connected to the ink-jet head 2 mechanically and electrically, a holding member 4 which presses the wiring member 3 against the ink-jet head 2, and a heat sink 5 which is provided in order to release the heat generated from driver IC's 14 (signal supply sections) mounted on the wiring member 3.

In order to carry the ink discharge apparatus 1 on the carriage 100, an assembly 6, which is obtained by assembling the ink-jet head 2, the wiring member 3, and the holding member 4, is attached to the carriage 100 from the lower side. In this situation, the lower surface of the ink-jet head 2 is arranged at the outer bottom portion of the carriage 100. The wiring member 3 and the holding member 4 are accommodated in the carriage 100 via an opening formed through the lower surface of the carriage 100. The heat sink 5 is accommodated in the carriage 100 from the upper side. The heat sink 5 is assembled to the wiring member 3 and the holding member 4 contained in the carriage 100.

Figure 2:
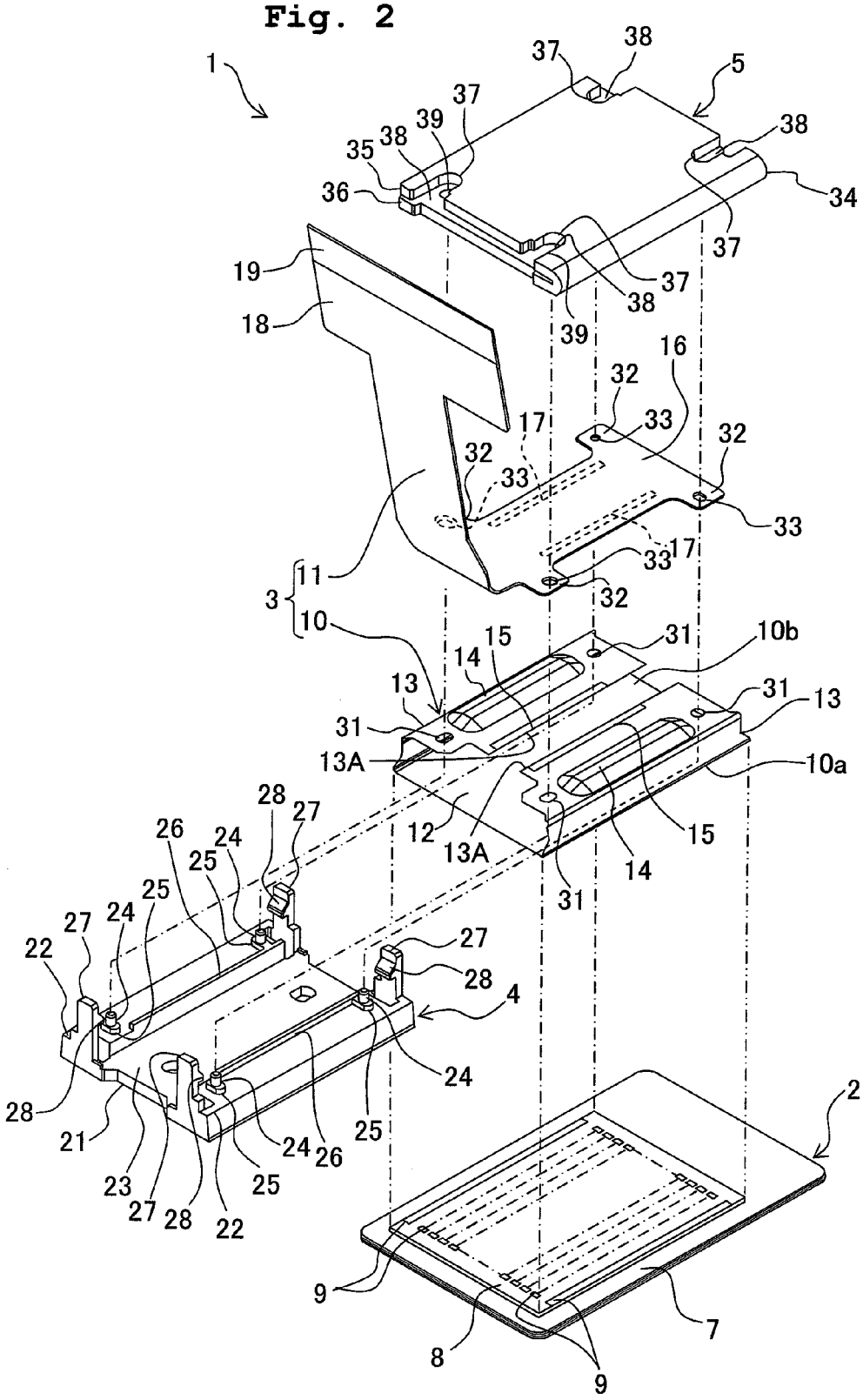
FIG. 2 shows an exploded perspective view illustrating the ink discharge apparatus shown in FIG. 1.

Next, the structure or the arrangement of the ink discharge apparatus 1 will be explained along with the outline of the production steps with reference to FIG. 2. As shown in FIG. 2, the ink-jet head 2 is provided with a flow passage unit 7 and a pressure applying device 8 (pressure applying mechanism). The lower surface of the flow passage unit 7 forms the lower surface of the ink-jet head 2, on which the plurality of nozzles (not shown) for discharging the ink are open. The plurality of nozzles form, for example, four nozzle rows each of which discharges one of the four color inks. Each of the nozzle rows extends in a direction (predetermined direction) perpendicular to the scanning direction of the liquid supply unit 104. The pressure applying device 8 selectively applies the pressure to the ink flowing through the flow passage unit 7 in order to discharge the ink from the respective nozzles. The type or form of the pressure applying device 8 is not specifically limited. However, this embodiment refers to a case in which a piezoelectric actuator is applied by way of example.

In this arrangement, the pressure applying device 8 is composed of stacked thin plate piezoelectric ceramics. Although any detailed illustration is omitted, first and second internal electrodes (not shown) are provided to interpose the piezoelectric ceramics in the pressure applying device 8. A predetermined constant electric potential (for example, 0 V) is applied to the first internal electrode. A waiting electric potential which is the same electric potential as the constant electric potential and a driving electric potential (for example, 30 V) which is different from the constant electric potential are selectively applied to the second internal electrode. When the driving electric potential is applied to the second internal electrode, the portion, which is interposed between the first and second internal electrodes, causes the strain deformation by exhibiting the inverse piezoelectric effect brought about by the difference in the electric potential. The pressure is applied to the ink in the flow passage unit 2 in accordance with the deformation, and the ink is discharged downwardly from the nozzles. The second internal electrodes are provided individually corresponding to the respective nozzles. The respective nozzles can discharge the ink independently from each other. A large number of surface electrodes 9, which are in conduction with the internal electrodes, are provided on the upper surface of the pressure applying device 8. The required electric potential can be applied to the required internal electrode from the outside via the surface electrode 9.

The wiring member 3 has one sheet of a COF board 10 which is connected to the upper surface of the pressure applying device 8 and one sheet of an FPC board 11 which is connected to the COF board 10. The both boards 10, 11 are produced such that a large number of wiring lines composed of a metal material are printed and formed on a resin sheet, and the wiring lines are coated with a resist layer. The both boards 10, 11 are flexible and elastic (resilient).

The COF board 10 is formed to have a substantially rectangular shape. The central portion in the longitudinal direction thereof is a connecting portion 12 which is to be connected to the upper surface of the pressure applying device 8. A large number of connecting terminals (not shown) are exposed on one surface of the connecting portion 12. In the following description, the one surface of the COF board 10 is conveniently referred to as "first surface 10*a*", and the back surface thereof is conveniently referred to as "second surface 10*b*".

In order to assemble the COF board 10 to the pressure applying device 8, the first surface 10*a* of the COF board 10 is directed downwardly, and the connecting portion 12 is overlapped on the upper surface of the pressure applying device 8 from the upper side. The both end portions in the longitudinal direction of the COF board 10 are a pair of extending portions 13 which extend on mutually opposite sides from the connecting portion 12. Each of the extending portions 13 extends in a direction perpendicular to the direction in which each of the nozzle rows extends. The COF board 10 is mechanically joined to the pressure applying device 8 so that the connecting terminals (not shown) are in electrical conduction with the surface electrodes 9 by using any board-connecting technique including, for example, the soldering and the so-called cover coat technique.

After the COF board 10 is connected to the pressure applying device 8, the holding member 4 is placed on the second surface 10*b* of the connecting portion 12 which is directed upwardly. Accordingly, the connecting portion 12 is hardly exfoliated from the pressure applying device 8. It is possible to avoid any electrical inconvenience or malfunction of the ink discharge apparatus 1.

One driver IC 14 is mounted on each of the extending portions 13. Each of the driver IC's 14 supplies, as the driving signal, the driving electric potential to be applied to the second internal electrode (not shown) of the pressure applying device 8. A plurality of wiring lines (not shown) extend toward the connecting portion 12 from each of the driver IC's 14. The wiring lines are connected to the connecting terminals (not shown) to be in electrical conduction with the surface electrodes 9 corresponding to the second internal electrodes respectively.

Structurally, the driver IC 14 is a strip-shaped chip. The respective driver IC's 14 are mounted on the first surface 10*a* of the COF board 10, and they are arranged in the vicinity of the forward end portions 13A of the extending portions 13. The longitudinal direction thereof is the widthwise direction of the COF board 10. A pair of first wiring terminals 15 are provided in the widthwise direction of the COF board 10 at the forward end portions 13A of the pair of extending portions 13 respectively. Microscopically, a large number of fine terminals are arranged in the widthwise direction of the COF board 10 on the pair of first wiring terminals 15 respectively.

Figure 4:
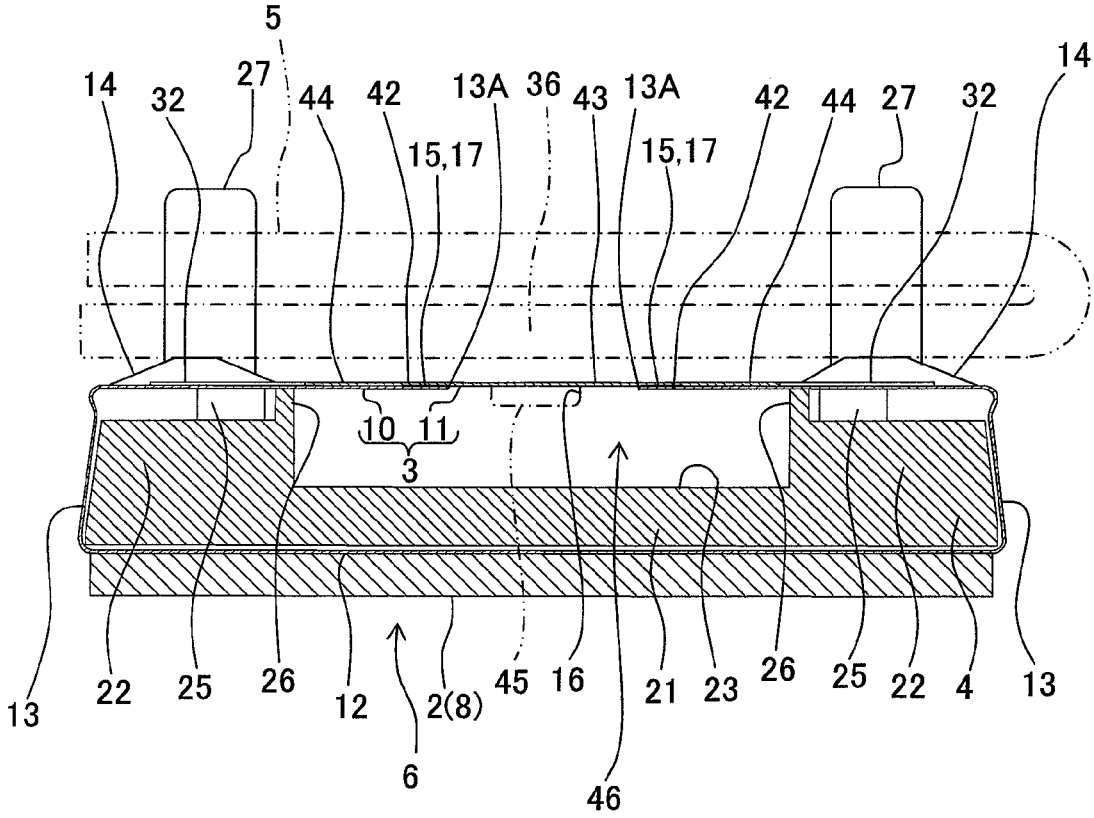
FIG. 4 shows a sectional view taken and sectioned along a line IV-IV shown in FIG. 3C, which depicts a sectional view of the ink discharge apparatus in the state shown in FIG. 3C.
Figure 5A:
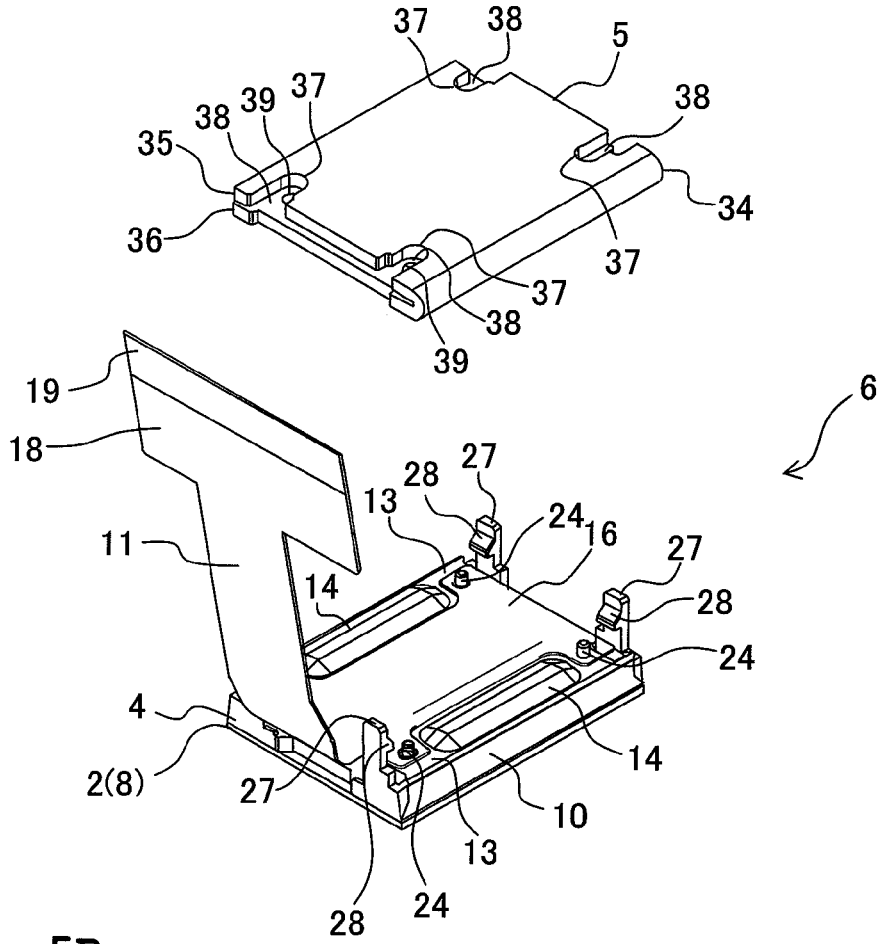
FIG. 5A shows a perspective view illustrating a state which is provided before a heat sink is assembled to a wiring member and a holding member.
Figure 5B:
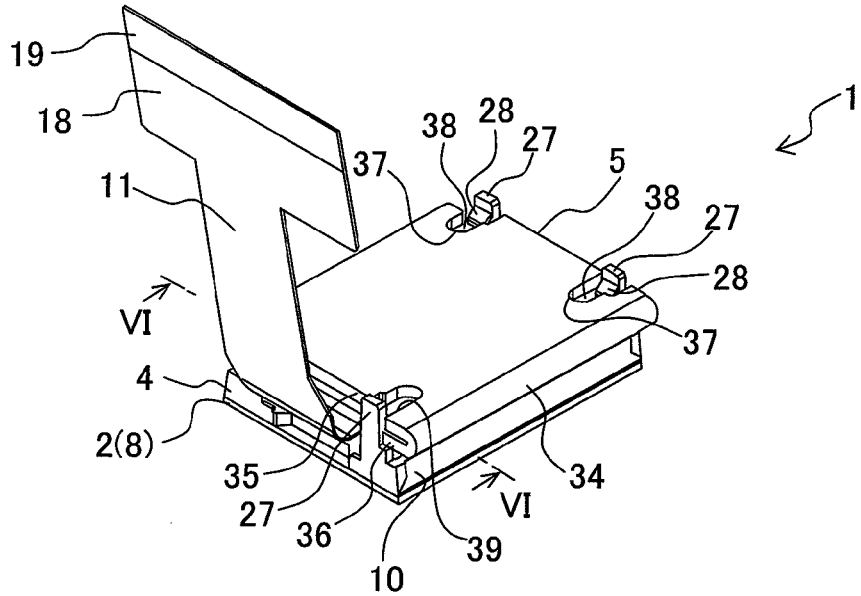
FIG. 5B shows a perspective view illustrating a state in which the assembling is completed.

FIG. 2 shows the postures of the respective parts in the state of the completion of the assembling of the ink discharge apparatus 1 (see FIG. 5B). As described in detail later on with reference to FIGS. 3 to 6, the pair of extending portions 13 of the COF board 10 are bent in this state so that the pair of extending portions 13 are disposed along the outer surface of the holding member 4 and the respective forward end portions 13A thereof face with each other on the upper side which is opposite to the side of the pressure applying device 8 as viewed from the connecting portion 12. In other words, the COF board 10 of the ink discharge apparatus 1 has a C-shaped posture in cross section in the state in which the assembling is completed.

The first surface 10*a* of the COF board 10 as described above constitutes the outer circumferential surface, and the second surface 10*b* constitutes the inner circumferential surface. The driver IC's 14 and the pair of first wiring terminals 15 are provided on the first surface 10*a*, they are positioned over or above the connecting portion 12, and they are directed upwardly. Further, the pair of first wiring terminals 15 are arranged in parallel while providing a spacing distance therebetween.

The FPC board 11 is overlapped from the upper side on the forward end portions 13A of the pair of folded extending portions 13. The FPC board 11 is formed to have a band-shaped configuration. One end portion in the longitudinal direction thereof is a connecting portion 16 which is to be connected to the portions of the first surface 10*a* of the pair of extending portions 13 of the COF board 10. A pair of second wiring terminals 17 are provided so that they are aligned in parallel on one surface of the connecting portion 16. Microscopically, the second wiring terminal 17 also has a large number of fine terminals which are arranged in the longitudinal direction of the FPC board 11. In the following description, the one surface of the FPC board 11 is conveniently referred to as "third surface", and the back surface thereof is conveniently referred to as "fourth surface".

In order to assemble the FPC board 11 to the COF board 10, the third surface of the FPC board 11 is directed downwardly, and the connecting portion 16 is overlapped from the upper side on the portions of the first surface 10*a* of the pair of extending portions 13. The connecting portion 16 is provided so that the connecting portion 16 overlaps the forward end portions 13A of the pair of extending portions 13 respectively. The FPC board 11 is mechanically joined to the upper side of the COF board 10 so that the large number of terminals, which constitute the second wiring terminals 17, are in electrical conduction with the corresponding terminals which constitute the first wiring terminals 15 respectively by using any board-connecting technique including, for example, the soldering.

The connecting portion 16 has a sufficiently wide width in order that the first wiring terminals 15 and the second wiring terminals 17 are brought in contact with each other in the upward-downward direction while overlapping the forward end portions 13A of the pair of extending portions 13 respectively. On the other hand, the driver IC's 14 extend in the widthwise direction of the COF board 10 in the vicinity of the forward end portions 13A of the pair of extending portions 13 respectively. The widthwise dimension of the connecting portion 16 is restricted so that the driver IC's 14 are not coated or covered therewith. Therefore, even when the FPC board 11 is connected on the upper side of the COF board 10, the driver IC's 14 are still exposed upwardly.

The other end portion 18 in the longitudinal direction of the FPC board 11 is connected to a receptacle connector (not shown) mounted on a control board (not shown). Board connecting terminals 19 are arranged along the forward circumferential end edge of the other end portion 18. The exemplary embodiment shown in the drawing is illustrative of the case in which the board connecting terminals 19 are provided on the third surface by way of example. However, the board connecting terminals 19 may be provided on the fourth surface which is the back surface thereof. When the other end portion 18 of the FPC board 11 is received by and connected to the connector, the board connecting terminals 19 are in conduction with contacts (not shown) of the connector. The control board is carried on the carriage 100 (see FIG. 1) together with the ink discharge apparatus 1, and the control board supplies the control signal to the driver IC's 14. The control signal is inputted into the driver IC's 14 via the wiring lines of the FPC board 11, the second wiring terminals 17, the first wiring terminals 15, and the wiring lines of the COF board 10.

The heat sink 5 is overlapped from the upper side of the fourth surface of the connecting portion 16 of the FPC board 11. The heat sink 5 is formed by processing a metal plate composed of a metal having the high thermal conductivity (for example, aluminum or the like).

As described above, the driver IC's 14 are exposed upwardly after the FPC board 11 is connected to the COF board 10. The driver IC 14, which has the form of chip, has the height which is sufficiently greater than the thickness of the FPC board 11. Therefore, when the heat sink 5 is installed from the upper side, the lower surface thereof abuts against the upper surfaces of the driver IC's 14. Accordingly, even when the driver IC's 14 generate the heat during the operation of the ink discharge apparatus 1, the heat can be released to the heat sink 5, which contributes to the stable operation of the ink discharge apparatus 1.

In the ink discharge apparatus 1 constructed as described above, one driver IC 14 is mounted on each of the pair of extending portions 13 of one sheet of the COF board 10. One sheet of the FPC board 11 is connected to one sheet of the COF board 10. In this arrangement, the pair of extending portions 13 of the COF board 10 are bent to provide the C-shaped cross section so that the respective forward end portions 13A thereof face with each other on the side opposite to the side on which the pressure applying device 8 is arranged. The end portion of the FPC board 11 is overlapped with the forward end portions 13A of the pair of extending portions 13 which are facing each other respectively. In this way, the structure, in which one sheet of the FPC board 11 is used, is realized.

Accordingly, it is possible to decrease the number of the FPC board or FPC boards 11 for constructing the ink discharge apparatus 1 as compared with a structure in which one FPC board 11 is individually connected to each of the forward end portions 13A of the pair of extending portions 13. It is possible to suppress the production cost of the ink discharge apparatus 1. Further, it is possible to decrease the number of the connector or connectors mounted on the control board (not shown), and it is possible to decrease the amount of the operation for connecting the FPC board 11 and the COF board 10. Accordingly, it is possible to further suppress the production cost, and it is possible to suppress any complicated production step.

The ink discharge apparatus 1 of this embodiment is provided with the structure or the arrangement which makes it possible to produce the foregoing structure or the arrangement with ease. This feature will be explained below along with detailed production steps to be performed after the holding member 4 is placed on the second surface 10*b* of the connecting portion 12 of the COF board 10 with reference to FIGS. 2 to 6.

As shown in FIG. 2, the holding member 4 has a base portion 21 which has a rectangular plate-shaped form as viewed in a plan view. The lower surface of the base portion 21 is placed on the second surface 10*b* of the connecting portion 12 of the COF board 10. The outer shape dimension of the base portion 21 is approximately equal to that of the upper surface of the pressure applying device 8. Accordingly, the connecting portion 12 is effectively prevented from being exfoliated from the pressure applying device 8.

A pair of protrusions 22 are provided at upper positions of the base portion 21. The protrusions 22 are provided along the two circumferential edges which extend in parallel to the widthwise direction of the COF board 11 and which are included in the rectangular circumferential edges of the base portion 21 in the state in which the holding member 4 is placed on the second surface 10*b* of the COF board 10. On the contrary, when the pair of protrusions 22 are provided as described above, the portion, which is interposed between the pair of protrusions 22, is formed as a recess 23 which is dented downwardly with respect to the upper surface of the protrusions 22 on the upper side of the base portion 21.

Two positioning pins 24 (positioning mechanisms) protrude upwardly from each of the protrusions 22. The positioning pins 24 are arranged while being separated from each other by a predetermined distance in relation to the extending direction of the protrusion 22 (i.e., in the widthwise direction of the COF board 10). As a result, the holding member 4 is provided with the four positioning pins 24 in total.

In particular, raising portions 25, which raise the surroundings around the installation positions of the positioning pins 24, are provided on the upper surface of the protrusion 22. The positioning pins 24 protrude upwardly from the upper surfaces of the raising portions 25. A rib 26, which extends in the extending direction of the protrusion 22 (in the widthwise direction of the COF board 10), is arranged in connection with the raising portions 25 corresponding to the positioning pins 24 disposed on one side. The heights of the raising portions 25 are equal to the height of the rib 26. The upper surfaces of the raising portions 25 are flush with the upper surface of the rib 26.

Four perpendicular walls 27 are provided upstandingly from the outer edges of the base portion 21. Wedge tabs 28 are integrally provided on the inner side surfaces of the perpendicular walls 27. The wedge tab 28 is formed to have a triangular cross section. Each of the wedge tabs 28 has a tapered surface disposed on the upper side and a horizontal bottom surface disposed on the lower side.

Two positioning holes 31 (positioning mechanisms), which are separated from each other in the widthwise direction, penetrate through each of the forward end portions 13A of the pair of extending portions 13 of the COF board 10. Further, four overhang portions 32 are continued from the connecting portion 16 of the FPC board 11. One positioning hole 33 (positioning mechanism) penetrates through each of the overhang portions 32. As a result, the four positioning holes 31 in total and the four positioning holes 33 in total are formed for the COF board 10 and the FPC board 11 respectively.

The distance between the positioning pins 24 provided on the same protrusion 22 is equal to the distance between the positioning holes 31 provided through the same extending portion 13 as viewed in a plan view. If the centers of the positioning pins 24 disposed adjacently to one another are virtually connected with lines as viewed in a plan view, it is possible to draw a rectangle. A virtual rectangle can be also drawn for the positioning holes 33 of the FPC board 11 in the same manner as described above. The virtual rectangle concerning the positioning holes 33 is congruent with the virtual rectangle concerning the positioning pins 24.

The heat sink 5 is formed by folding and bending the metal plate into a hairpin form. Accordingly, an upper plate portion 35 and a lower plate portion 36 extend from a U-shaped bent portion 34 having a large curvature so that the upper plate portion 35 and the lower plate portion 36 are aligned in parallel while providing a slight clearance. The heat sink 5, which is formed as described above, has a rectangular shape as viewed in a plan view. Recessed grooves 37, which are provided by cutting out the upper plate portion 35 from the outer edges toward the inside, are formed for the upper plate portion 35. Accordingly, the portions of the upper surface of the lower plate portion 36, which correspond to the positions of the formation of the recessed grooves 37, are exposed upwardly as viewed in a plan view. The four recessed grooves 37 are formed for the upper plate portion 37. Therefore, exposed portions 38 are formed at four positions of the lower plate portion 36. One through-hole 39 is formed through each of the exposed portions 38. A virtual rectangle can be also depicted in relation to the through-holes 39 in the same manner as described above. The virtual rectangle is congruent with the virtual rectangle concerning the positioning pins 24.

Figure 3A:
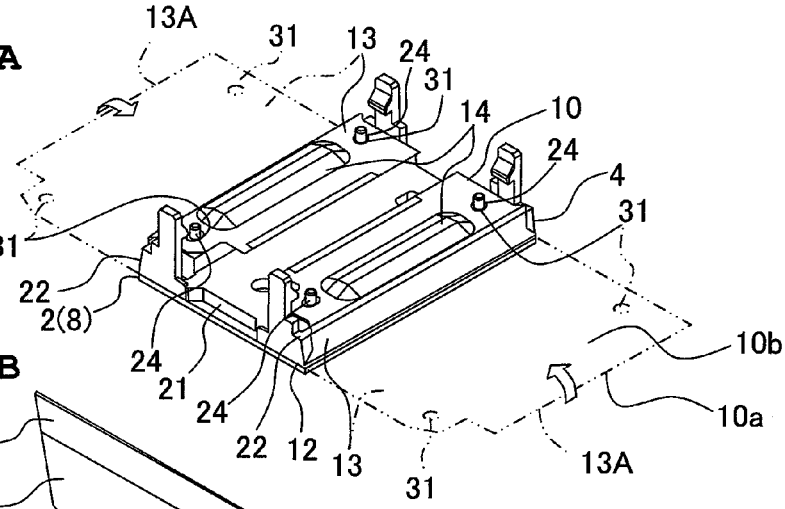
FIG. 3A shows a perspective view illustrating a state in which a COF board is bent and folded and forward end portions of a pair of extending portions of the COF board are positioned respectively.

FIG. 3A shows a state in which the holding member 4 is placed after the ink-jet head 2 is connected to the connecting portion 12 of the COF board 10. In the respective drawings of FIGS. 3 to 6, only the pressure applying device 8 is conveniently depicted as the part of the ink-jet head 2, and the flow passage unit 7 is omitted from the illustration.

As shown in FIG. 3A, when the pair of extending portions 13 are bent and folded after the holding member 4 is placed on the second surface 10*b* of the COF board 10, one extending portion 13 is folded back in a U-shaped form along the outer surfaces of the base portion 21 and the protrusion 22. Further, the two positioning holes 31, which are formed in the vicinity of the forward end portion 13A of the extending portion 13, are fitted from the upper side into the positioning pins 24 which protrude from the upper surface of the protrusion 22. As for the other extending portion 13, the positioning holes 31 are fitted into the positioning pins 24 in the same manner as described above. When this state is provided, the COF board 10, which has the flexibility, intends to return into the original shape on account of the elastic or resilient force of the COF board 10 itself. The elastic force is supported by the positioning pins 24 such that the circumferential edges of the positioning holes 31 abut against the outer circumferential surfaces of the positioning pins 24.

When a state, in which the four positioning pins 24 are inserted into the positioning holes 31 of the COF board 10 as described above, is provided, the posture, in which the pair of extending portions 13 of the COF board 10 are bent and folded in the U-shaped forms respectively, is maintained. In this situation, the forward end portions 13A of the pair of extending portions 13 of the COF board 10 are facing one another in such a state that they are approached to one another and they are separated from each other, based on the distances between the positioning pins 24 provided on the pair of protrusions 22 respectively. In this way, the positioning pins 24 and the positioning holes 31 cooperate with each other, and thus the forward end portion 13A of one extending portion 13 can be positioned with respect to the forward end portion 13A of the other extending portion 13.

Parts of the second surface 10*b* of the extending portions 13 are placed on the upper surfaces of the ribs 26 and the raising portions 25 of the holding member 4. The ribs 26 extend in the widthwise direction of the COF board 10. However, the portions of the second surface 10*b* of the extending portions 13, which are disposed on the back side of the portions of the provision of the first wiring terminals 15, are placed on the upper surfaces of the ribs 26 in the state in which the positioning pins 24 are inserted into the positioning holes 31.

Figure 3B:
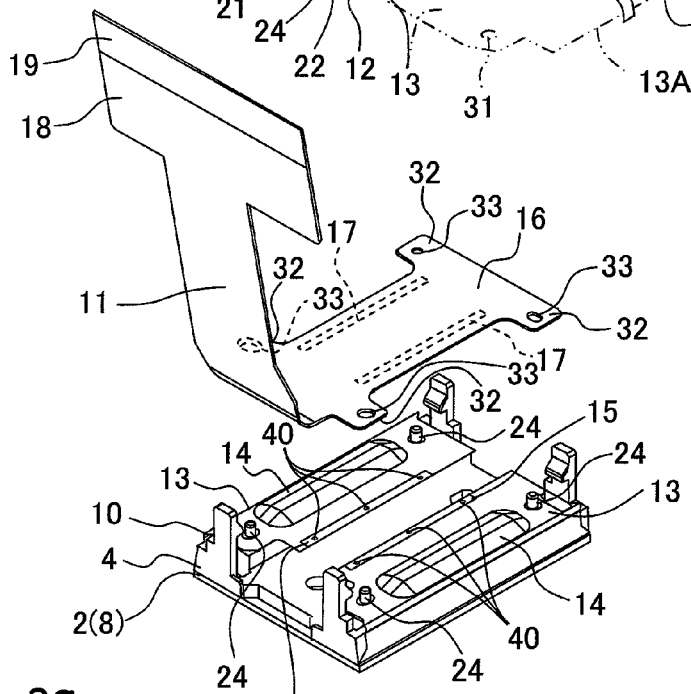
FIG. 3B shows a perspective view illustrating a state which is provided before an FPC board is connected to the COF board.

As shown in FIG. 3B, when the FPC board 11 is assembled to the COF board 10 by the soldering, for example, the conductive material 40 such as the solder or the like is installed on the upper surfaces of the first wiring terminals 15 before the FPC board 11 is assembled to the COF board 10. The first wiring terminals 15 are supported by the ribs 25. Therefore, the conductive material 40 can be installed stably.

When the FPC board 11 is overlapped on the COF board 10 from the upper side, the positioning holes 33 of the FPC board 11 are fitted into the positioning pins 24 from the upper side.

Figure 3C:
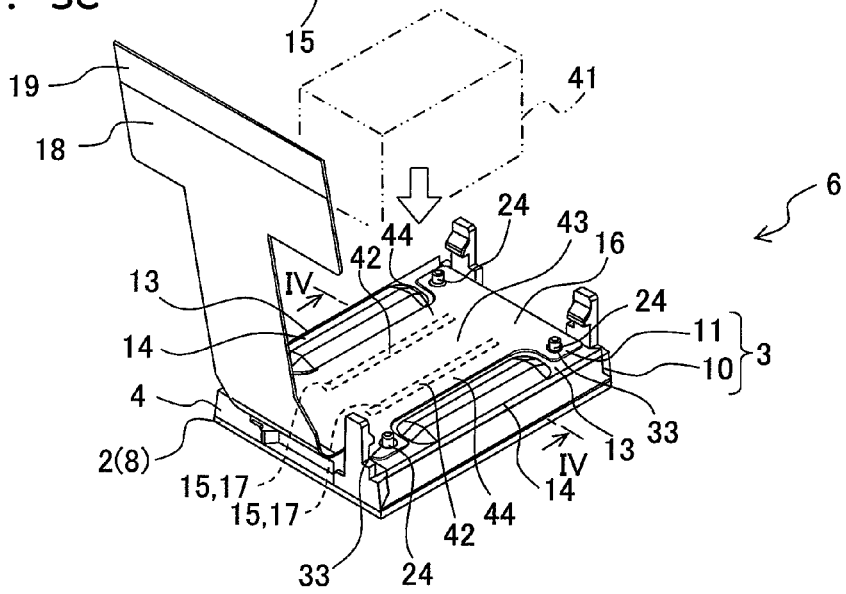
FIG. 3C shows a perspective view illustrating a state in which the FPC board is connected to the COF board while being positioned with respect to the forward end portions of the pair of extending portions of the COF board.

As shown in FIG. 3C, when the state, in which the four positioning pins 24 are inserted into the positioning holes 33 of the FPC board 11, is provided, the connecting portion 16 of the FPC board 11 is positioned with respect to the pair of extending portions 13 of the COF board 10 by the aid of the four positioning pins 24. When the connecting portion 16 of the FPC board 11 is positioned as described above, the state is given, in which the connecting portion 16 overlaps the forward end portions 13A of the pair of extending portions 13 as described above. The pair of second wiring terminals 17 are overlapped on the upper side of the first wiring terminals 15.

Subsequently, a heater 41 is pressed to abut against the upper side of the fourth surface of the connecting portion 16 of the FPC board 11. The conductive material 40 (see FIG. 3B) is melted by the heat supplied from the heater, and then the conductive material 40 is solidified. Accordingly, the first wiring terminals 15 and the second wiring terminals 17 are in electrical conduction with each other by the solidified conductive material 40, and they are mechanically joined to one another. In this way, the assembly 6, which is to be assembled from the lower side to the carriage 100 (see FIG. 1), is produced.

As described above, in the embodiment of the present invention, the positioning pins 24 are provided on the holding member 4 arranged on the inner circumferential surface side of the COF board 10 bent and folded to provide the C-shaped cross section, and the positioning holes 31, 33, which are provided for the respective boards 10, 11, are fitted into the positioning pins 24. Accordingly, the forward end portions 13A of the pair of extending portions 13 of the COF board 10 are positioned with each other, and the connecting portion 16 of the FPC board 11 can be positioned with respect to the forward end portions 13A respectively. Therefore, the FPC board 11 can be connected to the COF board 10 without any positional deviation. Therefore, the second wiring terminals 17 provided on the FPC board 11 and the first wiring terminals 15 provided on the COF board 10 can be reliably in the electrical conduction. It is possible to secure the reliability as the wiring member 3 for electrically connecting the control board (not shown) and the ink-jet head 2.

Although the COF board 10, which is bent and folded to provide the C-shaped cross section, exhibits the elastic or resilient force during the period in which the operation is performed to assemble the FPC board 11 to the COF board 10, the elastic force is supported by the positioning pins 24, and the posture is maintained. Therefore, it is unnecessary to prepare any exclusive jig in order to maintain the posture. It is possible to easily perform the operation for overlapping the FPC board 11 on the COF board 10 and the operation for connecting the both boards 10, 11 to one another.

The forward ends of the four positioning pins 24 protrude upwardly as compared with the FPC board 11 in the state in which the positioning holes 33 of the FPC board 11 are fitted. Therefore, the COF board 10 and the FPC board 11 are retained by the positioning pins 24, and they are hardly disengaged from the holding member 4. Therefore, it is easy to stably perform the soldering operation.

The pair of second wiring terminals 17, which are aligned in parallel, are provided on the connecting portion 16 of the FPC board 11. The welding areas with respect to the first wiring terminals 15 are also formed so that they are aligned in parallel along therewith. The positioning holes 33 of the FPC board 11 are formed at the overhang portions 32 which protrude outwardly from the both end portions in the extending direction of the welding areas respectively. In other words, the connecting portion 16 of the FPC board 11 is retained by the cooperation of the positioning pins 24 and the positioning holes 33 as described above at the four corners disposed outside the welding areas. Therefore, it is possible to satisfactorily avoid any exfoliation after the welding of the FPC board 11 to the COF board 10 by the positioning pins 24 of the embodiment of the present invention, and it is possible to reinforce the FPC board 11 against the exfoliation.

As shown in FIG. 4, owing to the arrangement of the wiring member 3 as described above, the portion of the wiring member 3, which is disposed over or above the pressure applying device 8, is formed in a form of endless loop in cross section while the COF board 10 and the connecting portion 16 of the FPC board 11 are integrated into one unit. Those concerning the connecting portion 16 of the FPC board 11 include a pair of welding portions 42 which are overlapped on the first wiring terminals 15 of the COF board 10 and which are welded to the COF board 10, a bridge portion 43 which continuously connects the pair of welding portions 42 and which overlaps the forward end portions 13A of the pair of mutually separated extending portions 13, and covering portions 44 which extend on the sides opposite to the bridge portion 43 from the pair of welding portions 42 and which at least partially cover the areas of the COF board 10 disposed between the portions of the provision of the first wiring terminals 15 and the portions of the provision of the driver IC's 14.

As described above, the portions of the COF board 10, which are disposed on the side of the connecting portion 12 as viewed from the wiring terminals 15, are covered with the covering portions 44 of the FPC board 11. Therefore, even when the conductive material 40 (see FIG. 3B) protrudes on the side of the connecting portion 12 from the first wiring terminals 15 during the melting, the protruding conductive material can be covered with the covering portions 44. In this way, it is possible to avoid the exposure of the conductive material in the upward direction. Therefore, it is possible to avoid the occurrence of any electrical inconvenience or malfunction which would be otherwise caused by the protruding conductive material. As depicted by two-dot chain lines, for example, the heat sink 5 is overlapped from the upper side on the connecting portion 16 of the FPC board 11. However, it is possible to avoid the formation of any short circuit of the conductive material with respect to the heat sink 5.

The bridge portion 43 is positioned over or above the recess 23 of the holding member 4, and a relatively large space 46 is secured on side of the lower surface of the bridge portion 43. Therefore, in the case of the wiring member 3 of this embodiment, the space 46 can be utilized to mount an electronic part 45 including, for example, a capacitor and a resistor on the third surface of the connecting portion 16 of the FPC board 11. The place, on which the electronic part 45 can be mounted, is increased on the surface of the FPC board as described above. Therefore, the degree of freedom is enhanced for the wiring layout of the FPC board, and the degree of freedom of the design is enhanced for the electrical circuit to be set between the control board and the pressure applying device.

The driver IC's 14 are provided in the vicinity of the forward end portions 13A of the extending portions 13 to which the FPC board 11 is connected. In order to stabilize the electric potential generated by the driver IC 14, it is preferable that the electronic part such as a bypass capacitor or the like is arranged at a position disposed adjacently to the driver IC 14 as closely as possible, and the wiring line length, which ranges from the electronic part and the driver, is decreased as shorter as possible. In this embodiment, such an electronic part can be easily arranged on the connecting portion 16 of the FPC board 11. Therefore, it is possible to provide the wiring member 3 which contributes to the stable operation of the driver IC 14.

Next, an explanation will be made with reference to FIGS. 5 and 6 about the assembling of the heat sink 5 and the assembly 6 while omitting the carriage 100 from the illustration. As shown in FIG. 5A, the through-holes 39 of the heat sink 5 are positioned with respect to the positioning pins 24 as viewed in a plan view, and the heat sink 5 is overlapped on the wiring member 3 from the upper side. In this way, the lower surface of the lower plate portion 36 of the heat sink 5 abuts against the tapered surfaces of the wedge tabs 28. When the heat sink 5 is pressed downwardly, the perpendicular walls 27 are elastically deformed outwardly.

As shown in FIG. 5B, when the lower plate portion 36 rides over the wedge tabs 28 to move downwardly, the perpendicular walls 27 are restored to have the vertically extending postures. Accordingly, the heat sink 5 is assembled to the assembly 6, and the assembling of the ink-jet head 1 is completed. In this state, the bottom surfaces of the wedge tabs 28 are arranged just over the upper surfaces of the exposed portions 38. Therefore, even when any external force, which is directed in the upward direction, unexpectedly acts on the heat sink 5 after the completion of the assembling of the ink discharge apparatus 1, the wedge tabs 28 abut against the exposed portions 38 when the heat sink 5 is moved upwardly. Accordingly, it is possible to regulate the upward movement of the heat sink 5, and it is possible to prevent the heat sink 5 from being disengaged from the assembly 6.

Figure 6:
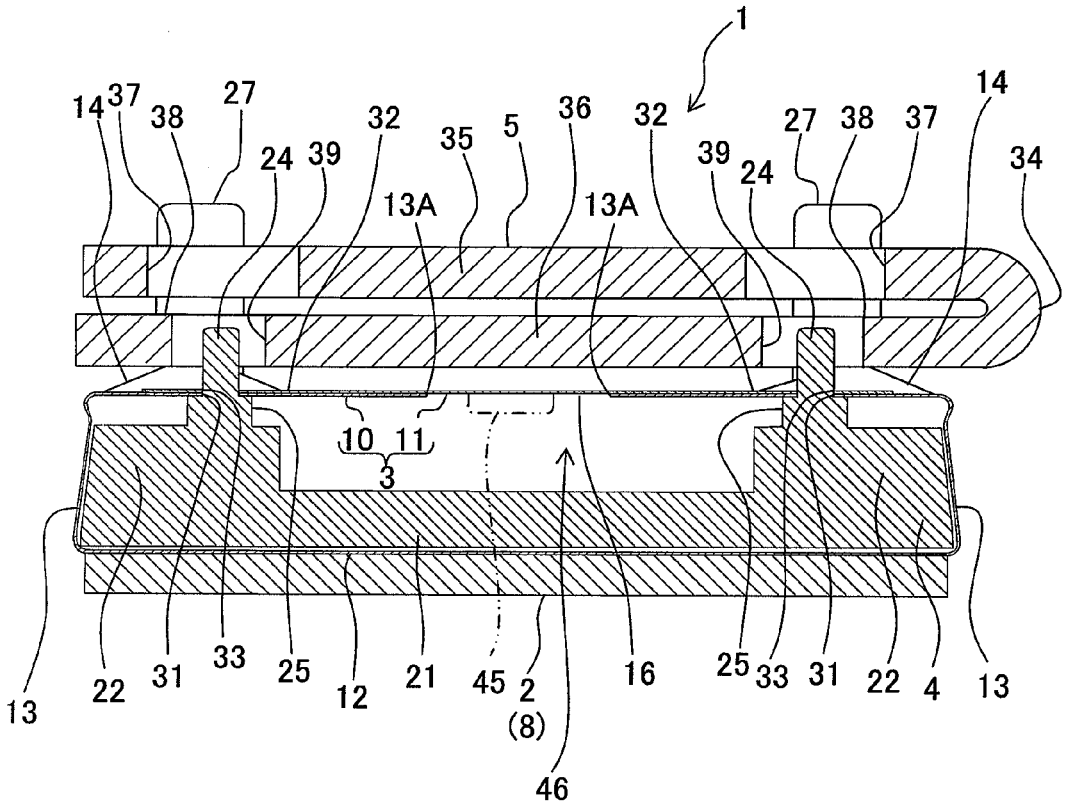
FIG. 6 shows a sectional view illustrating the ink discharge apparatus, which is taken and sectioned along a line VI-VI shown in FIG. 5B.

As shown in FIG. 6, the lower surface of the lower plate portion 36 of the heat sink 5 abuts against the upper surfaces of the driver IC's 14 in the state in which the assembling of the ink discharge apparatus 1 is completed. On the other hand, as described above, the forward ends of the positioning pins 24 protrude upwardly with respect to the FPC board 11 before the assembling of the heat sink 5. The heat sink 5 of this embodiment is provided with the through-holes 39. The respective through-holes 39 are fitted into the positioning pins 24. The structure, in which the positioning pins 24 are allowed to escape, is provided for the heat sink 5 as described above. Therefore, the lower surface of the lower plate portion of the heat sink 5 can be reliably brought in contact with the upper surfaces of the driver IC's 14. Further, the attachment position of the heat sink 5 is retained in the horizontal plane by the positioning pins 24. Therefore, it is possible to prevent the heat sink 5 from being disengaged from the assembly 6 during the practical use.

The embodiment of the present invention has been explained above. However, the arrangement described above is provided merely by way of example, which may be appropriately changed within a scope of the present invention. For example, in the embodiment of the present invention, the holding member 4 is provided with the positioning pins 24 in order to position COF 10 and FPC 11, and the positioning holes 31, 33, through which the positioning pins 24 are to be inserted, are formed through COF 10 and FPC 11 respectively. However, the mechanisms such as the positioning pins 24 and the positioning holes 31, 33, which are provided for the positioning, are not necessarily indispensable on condition that COF 10 can be merely maintained in the state of being bent in the C-shaped cross section and FPC 11 can be merely overlapped thereon and connected thereto from the upper side.

In the embodiment of the present invention, a pair of the extending portions 13 of the COF 10 extend on mutually opposite sides from the connecting portion 12 and each of the extending portions 13 is provided with one driver IC 14. However, when the number of the wiring lines are increased due to increase of the number of the nozzles, for example, one sheet of extending portion 13' provided with one driver IC 14' may be added to the COF 10 such that the added extending portion 13' extends in a direction perpendicular to the extending directions of the pair of the extending portions 13.

The present invention is not limited to the ink discharge apparatus for discharging the ink. The present invention is also applicable to any liquid droplet discharge apparatus to be used, for example, for any apparatus for discharging any liquid other than the ink, including, for example, the apparatus for producing the color filter of the liquid crystal display apparatus by discharging the coloring liquid and the apparatus for forming the electrical wiring line by discharging the conductive liquid.

What is claimed is:

1. A liquid droplet discharge apparatus which discharges liquid droplets, comprising:

a liquid droplet discharge head having a plurality of nozzles which discharge the liquid droplets and a pressure applying mechanism which selectively applies a pressure to discharge the liquid droplets from the nozzles;

a first wiring board which is flexible and which is connected to the pressure applying mechanism; and a second wiring board which is connected to the first wiring board, wherein the first wiring board has a pair of extending portions which extend on mutually opposite sides from a connecting portion connected to the pressure applying mechanism, the pair of extending portions are bent so that forward end portions thereof face each other, and the second wiring board is connected to the pair of extending portions so that the second wiring board overlaps the mutually facing forward end portions of the pair of extending portions.

2. The liquid droplet discharge apparatus according to claim 1, further comprising a positioning mechanism which positions the pair of extending portions of the first wiring board in such a state that the forward end portions thereof face with each other and which positions the second wiring board with respect to the pair of extending portions.

3. The liquid droplet discharge apparatus according to claim 2, further comprising:

a holding member which presses the connecting portion of the first wiring board against the pressure applying mechanism from a surface of the first wiring board disposed on a side opposite to the pressure applying mechanism, wherein: the forward end portions of the pair of extending portions face with each other on the side opposite to the pressure applying mechanism with respect to the holding member; and the positioning mechanism is arranged on a surface of the holding member disposed on the side opposite to the pressure applying mechanism.

4. The liquid droplet discharge apparatus according to claim 3, wherein:

positioning holes are formed through the first wiring board and the second wiring board respectively;

the positioning mechanism has positioning pins which are formed on the holding member and which are insertable into the positioning holes; and forward end portions of the positioning pins protrude from the first wiring board and the second wiring board in a state that the positioning pins are inserted into the positioning holes.

5. The liquid droplet discharge apparatus according to claim 4, wherein the pair of extending portions are provided with a pair of signal supply sections which supply a driving signal such that the pressure applying mechanism is driven by the driving signal, and a length of the positioning pin, which ranges from the holding member to the forward end portion, is greater than a thickness of the signal supply section.

6. The liquid droplet discharge apparatus according to claim 5, wherein the positioning holes are formed on both sides of the signal supply section in a direction perpendicular to an extending direction in which the pair of extending portions extend.

7. The liquid droplet discharge apparatus according to claim 6, further comprising:

a heat releasing member which releases heat generated from the pair of signal supply sections, wherein the holding member has a pair of hooks which are engageable with the heat releasing member and which are formed at both end portions in the direction perpendicular to the extending direction, and the pair of hooks are arranged while being aligned with the positioning pins in the direction perpendicular to the extending direction.

8. The liquid droplet discharge apparatus according to claim 1, wherein the second wiring board is led out in a direction perpendicular to an extending direction in which the pair of extending portions extend from the connecting portion.

9. The liquid droplet discharge apparatus according to claim 1, wherein:

the pair of extending portions are provided with a pair of signal supply sections which supply a driving signal such that the pressure applying mechanism is driven by the driving signal, and terminal portions, which are conducted with wiring lines provided on the second wiring board, are provided at the respective forward end portions of the pair of extending portions; and the second wiring board has conducting portions which are provided with wiring lines conducted with the terminal portions and which are overlapped on the terminal portions and a pair of covering portions which extend in directions to be mutually separated from the conducting portions and which at least partially cover areas of the pair of extending portions disposed between the terminal portions and the signal supply sections.

10. The liquid droplet discharge apparatus according to claim 9, further comprising:

a heat releasing member which releases heat generated from the pair of signal supply sections, wherein the heat releasing member has one of cutouts and holes such that the heat releasing member is in contact with the pair of signal supply sections without any interference with the positioning mechanism.

11. The liquid droplet discharge apparatus according to claim 1, wherein the plurality of nozzles form a plurality of nozzle rows each extending in a predetermined direction and each of the extending portions of the first wiring board extends in a direction perpendicular to the predetermined direction.

12. An image recording apparatus which records an image on a recording medium by discharging liquid droplets of a liquid, the apparatus comprising:

the liquid droplet discharge apparatus as defined in claim 1, and a tank which stores the liquid and which is connected to the liquid droplet discharge apparatus.

* * * * *